US007815492B2

(12) United States Patent
Sasaki et al.

(10) Patent No.: US 7,815,492 B2
(45) Date of Patent: Oct. 19, 2010

(54) SURFACE TREATMENT METHOD

(75) Inventors: Yasuharu Sasaki, Nirasaki (JP); Masakazu Higuma, Nirasaki (JP); Tadashi Aoto, Nirasaki (JP); Eiichiro Kikuchi, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 279 days.

(21) Appl. No.: 11/687,879

(22) Filed: Mar. 19, 2007

(65) Prior Publication Data

US 2008/0280536 A1 Nov. 13, 2008

Related U.S. Application Data

(60) Provisional application No. 60/788,105, filed on Apr. 3, 2006.

(30) Foreign Application Priority Data

Mar. 20, 2006 (JP) ..... 2006-077266

(51) Int. Cl.
*B24B 1/00* (2006.01)

(52) U.S. Cl. ..... 451/57; 451/41; 451/54; 451/59; 451/66; 451/303; 451/307

(58) Field of Classification Search ..... 451/41, 451/54, 57, 59, 65, 66, 285, 303, 307, 242, 451/246

See application file for complete search history.

(56) References Cited

U.S. PATENT DOCUMENTS 5,209,027 A * 5/1993 Ishida et al. ..... 451/41
5,749,769 A * 5/1998 Church et al. ..... 451/5
6,179,689 B1 * 1/2001 Ohno et al. ..... 451/41
6,971,946 B2 * 12/2005 Suzuki ..... 451/49
2001/0029158 A1 * 10/2001 Sasaki et al. ..... 451/66
2003/0190865 A1 * 10/2003 Somekh ..... 451/5
2005/0048880 A1 * 3/2005 Tolles et al. ..... 451/66

FOREIGN PATENT DOCUMENTS

JP 58153220 A * 9/1983
JP 5-190654 7/1993

* cited by examiner

*Primary Examiner*—Eileen P. Morgan
(74) *Attorney, Agent, or Firm*—Oblon, Spivak, McClelland, Maier & Neustadt, L.L.P.

(57) ABSTRACT

A surface treatment method that enables a surface of an electrostatic chuck to be smoothed, so as to improve the efficiency of heat transfer between the surface of the electrostatic chuck and a substrate. The electrostatic chuck is provided in an upper portion of a susceptor provided in a chamber of a substrate processing apparatus. In the surface treatment of the electrostatic chuck, a sprayed coating film is formed on the surface of the electrostatic chuck, next the surface of the electrostatic chuck is ground by bringing into contact therewith a grindstone, then the surface of the electrostatic chuck is ground flat by bringing into contact therewith a lapping plate onto a surface of which is sprayed a suspension, and then the surface of the electrostatic chuck is ground smooth by bringing into contact therewith a tape of a tape lapping apparatus.

6 Claims, 5 Drawing Sheets

SURFACE TREATMENT METHOD

BACKGROUND OF THE INVENTION

1. Field of the Invention

The present invention relates to a surface treatment method, and in particular relates to a surface treatment method for a sprayed coating film formed on a surface of an electrostatic chuck.

2. Description of the Related Art

Substrate processing apparatuses are known that carry out plasma processing such as etching processing on wafers as substrates. Such an apparatus has a housing chamber in which a wafer is housed, and a stage that is disposed in the housing chamber and on which the wafer is mounted. In the substrate processing apparatus, plasma is produced in the housing chamber, and the wafer is subjected to the etching processing by the plasma.

The stage has in an upper portion thereof an electrostatic chuck comprised of an insulating member having an electrode plate therein, the wafer being mounted on the electrostatic chuck. While the wafer is being subjected to the etching processing, a DC voltage is applied to the electrode plate, the electrostatic chuck attracting the wafer thereto through a Coulomb force or a Johnsen-Rahbek force generated by the DC voltage (see, for example, Japanese Laid-open Patent Publication (Kokai) No. H05-190654).

Moreover, a coolant chamber is provided inside the stage. A coolant, for example cooling water or a Galden fluid, at a predetermined temperature is supplied into the coolant chamber from a chiller unit. A processing temperature of the wafer attracted to and held on a surface of the electrostatic chuck is controlled through the temperature of the coolant.

Conventionally, the electrostatic chuck is subjected to surface treatment as shown in FIGS. 4A and 4C. First, a sprayed coating film is formed on the surface of the electrostatic chuck by thermally spraying with a ceramic such as alumina (FIG. 4A) . The sprayed coating film is shown enlarged in FIG. 4B. Next, a grindstone obtained by compacting together abrasive grains and making into a disk shape is brought into contact with the surface of the electrostatic chuck on which the sprayed coating film has been formed. The grindstone is then rotated, and also moved parallel to the surface of the electrostatic chuck on which the sprayed coating film has been formed. The electrostatic chuck is also rotated about an axis of rotation shown by the alternate long and short dash line in FIG. 4C. As a result, the surface of the electrostatic chuck is ground, i.e. processed, as shown enlarged in FIG. 4D.

However, as shown in FIG. 4D, an electrostatic chuck processed using the conventional method has a rough surface when viewed microscopically, and furthermore there are minute undulations on the surface of the electrostatic chuck. A wafer attracted to and held on the electrostatic chuck contacts the surface of the electrostatic chuck, and hence the temperature of the wafer depends on the contact area between the wafer and the surface of the electrostatic chuck. If the surface of the electrostatic chuck is rough, then the contact area between the wafer and the surface of the electrostatic chuck is low, and hence the thermal contact resistance of the contacting portion becomes high. In this case, when controlling the processing temperature of the wafer, in particular when reducing the temperature of the wafer, a high-performance chiller unit must be used.

Moreover, in recent years, with the diversification of semiconductor devices, a variety of etching characteristics have come to be required, for example there are cases in which it is required to realize etching at a low wafer temperature under high-density, high-ion energy plasma conditions. Under such high-density, high-ion energy plasma conditions, much heat is inputted into the wafer, and hence the temperature of the wafer increases greatly. To achieve both high-density, high-ion energy plasma and a low wafer temperature, it is thus necessary to use a chiller unit that can produce an extremely low temperature and hence has a high power consumption.

Moreover, in recent years, due to etched shapes becoming finer and more complex, etching processes have come to be divided into a plurality of steps, it being required to control the wafer temperature with good response when changing steps. However, in the case of a conventional electrostatic chuck, because the thermal contact resistance between the wafer and the surface of the electrostatic chuck is high, the wafer temperature cannot be controlled with good response by controlling the temperature of the coolant from the chiller unit. Moreover, even in the case of using, for example, a heater or a Peltier element as a temperature control device for the wafer in the electrostatic chuck, the wafer temperature still cannot be controlled with good response.

Moreover, conventionally, as a method of improving the efficiency of heat transfer between the wafer and the surface of the electrostatic chuck, a method of introducing a heat transfer gas in between the wafer and the surface of the electrostatic chuck has been proposed. However, with this method, to satisfy the above requirements on the etching characteristics, the pressure of the heat transfer gas must be greatly increased, so that in some cases the wafer may become detached from the electrostatic chuck. As a countermeasure, one can envisage increasing the value of the DC voltage applied to the electrode plate of the electrostatic chuck so as to increase the wafer attracting force. However, in this case, the voltage resistance of the insulating member of the electrostatic chuck must be increased, and setting the thickness of the insulating member which is a layer above the electrode plate in the electrostatic chuck so as to achieve both a good wafer attracting force and a good insulating member voltage resistance is difficult from a design perspective. The insulating member generally has a worse heat transfer coefficient than a metal, and hence if the insulating member is made thicker so as to increase the voltage resistance, then there is a problem that the efficiency of heat transfer becomes poor in this region.

SUMMARY OF THE INVENTION

It is an object of the present invention to provide a surface treatment method that enables a surface of an electrostatic chuck to be smoothed, so as to improve the efficiency of heat transfer between the surface of the electrostatic chuck and a substrate.

To attain the above object, in a first aspect of the present invention, there is provided a surface treatment method for a substrate mounting surface of a stage that is disposed in a substrate processing apparatus that carries out processing on a substrate and has the substrate mounted thereon, the method comprising a flattening step of improving a flatness of the substrate mounting surface, and a smoothing step of smoothing the substrate mounting surface whose flatness has been improved using tape coated with abrasive grains.

According to the above surface treatment method, the flatness of the substrate mounting surface is improved, and then the surface whose flatness has been improved is smoothed using tape coated with abrasive grains. As a result, an extreme surface layer of the substrate mounting surface can be smoothed. The contact area between a substrate and a surface of an electrostatic chuck that is the substrate mounting surface can thus be increased, and hence the efficiency of heat transfer between the substrate and the surface of the electrostatic chuck can be markedly improved. When controlling a processing temperature of the substrate, there is thus no need to use a high-performance chiller unit, and hence power saving can be achieved for the chiller unit. Moreover, even in the case that an etching process carried out on the substrate is divided into a plurality of steps, the temperature of the substrate can be controlled with good response when changing steps, and hence the requirements of a variety of etching characteristics can be met. Furthermore, because the efficiency of heat transfer between the substrate and the surface of the electrostatic chuck can be markedly improved, even in the case of wishing to reduce the temperature of the substrate, there is no need to excessively increase the pressure of a heat transfer gas, and hence detachment of the substrate from the electrostatic chuck can be prevented.

Preferably, the flattening step has a first flattening step of flattening the substrate mounting surface using a grindstone, and a second flattening step of further flattening the flattened substrate mounting surface using a plate coated with abrasive grains.

According to the above surface treatment method, the substrate mounting surface is flattened using a grindstone, and then the flattened surface is further flattened using a plate coated with abrasive grains. As a result, the flatness of the substrate mounting surface can be further improved. The efficiency of heat transfer between the substrate and the surface of the electrostatic chuck can thus be further improved, and hence power saving can be achieved for the chiller unit, and the requirements of a variety of etching characteristics can be met.

Preferably, the substrate mounting surface has a sprayed coating film formed thereon.

According to the above surface treatment method, the substrate mounting surface has a sprayed coating film formed thereon. As a result, the flatness of the substrate mounting surface can be improved easily, and the extreme surface layer of the substrate mounting surface can be smoothed easily.

To attain the above object, in a second aspect of the present invention, there is provided a surface treatment method for a sprayed coating film formed on a member to be disposed in a substrate processing apparatus that carries out processing on a substrate, the method comprising a flattening step of improving a flatness of a surface of the sprayed coating film, and a smoothing step of smoothing the surface of the sprayed coating film whose flatness has been improved using tape coated with abrasive grains.

According to the above surface treatment method, the flatness of the surface of the sprayed coating film is improved, and then the surface whose flatness has been improved is smoothed using tape coated with abrasive grains. As a result, an extreme surface layer of the sprayed coating film can be smoothed. For the member having the sprayed coating film formed thereon, contact heat transfer from the member to an adjacent member can thus be increased, and hence, for example, the adjacent member can be made to be at the same temperature as the member, or the temperature of a member not provided with a coolant chamber through which a coolant is directly passed can be controlled. In this case, if at least one of the mutually adjacent members is processed using the surface treatment method, then effects as for the surface treatment method in the first aspect of the present invention can be obtained for both of the mutually adjacent members.

Preferably, the flattening step has a first flattening step of flattening the surface of the sprayed coating film using a grindstone, and a second flattening step of further flattening the flattened surface of the sprayed coating film using a plate coated with abrasive grains.

According to the above surface treatment method, the surface of the sprayed coating film is flattened using a grindstone, and then the flattened surface is further flattened using a plate coated with abrasive grains. As a result, the flatness of the sprayed coating film can be further improved. The contact heat transfer between the mutually contacting members can thus be further increased.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First, a substrate processing apparatus having therein an electrostatic chuck processed using a surface treatment method according to a first embodiment of the present invention will be described.

Figure 1:
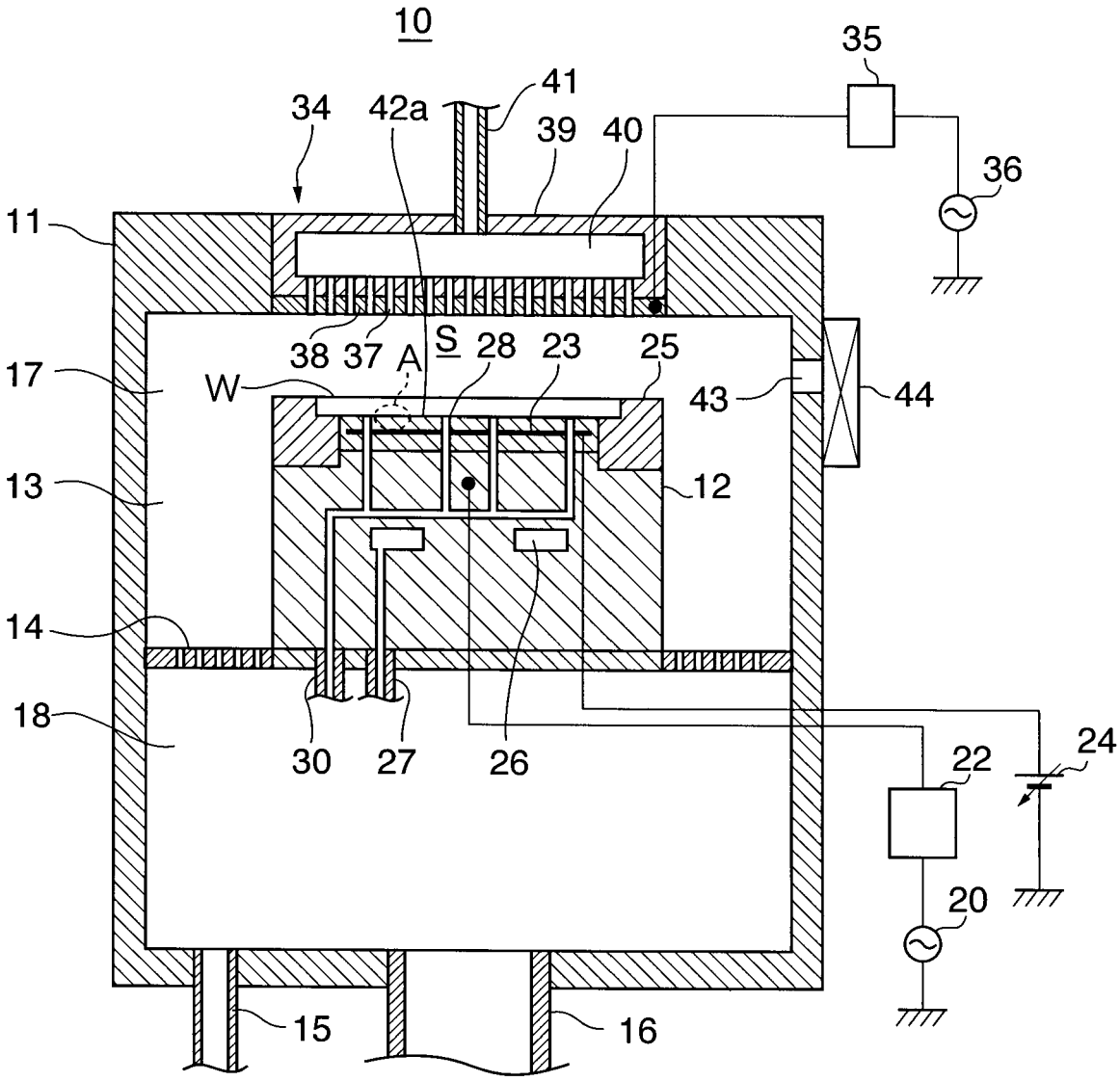
FIG. 1 is a sectional view schematically showing the construction of a substrate processing apparatus having therein an electrostatic chuck processed using a surface treatment method according to a first embodiment of the present invention.

FIG. 1 is a sectional view schematically showing the construction of the substrate processing apparatus having therein the electrostatic chuck processed using the surface treatment method according to the first embodiment of the present invention. The substrate processing apparatus is constructed such as to carry out etching processing on a semiconductor wafer as a substrate.

As shown in FIG. 1, the substrate processing apparatus 10 has a chamber 11 in which is housed a semiconductor wafer (hereinafter referred to merely as a "wafer") W having a diameter of, for example, 300 mm. A cylindrical susceptor 12 is disposed in the chamber 11 as a stage on which the wafer W is mounted. In the substrate processing apparatus 10, a side exhaust path 13 that acts as a flow path through which gas above the susceptor 12 is exhausted out of the chamber 11 is formed between an inner wall surface of the chamber 11 and a peripheral surface of the susceptor 12. A baffle plate 14 is disposed part way along the side exhaust path 13. The inner wall surface of the chamber 11 is covered with quartz or yttria ($Y_2O_3$).

The baffle plate 14 is a plate-shaped member having a large number of holes therein, and acts as a partitioning plate that partitions the chamber 11 into an upper portion and a lower portion of the chamber. Plasma, described below, is produced in the upper portion (hereinafter referred to as the "reaction chamber") 17 of the chamber 11 partitioned by the baffle plate 14. Moreover, a roughing exhaust pipe 15 and a main exhaust pipe 16 that exhaust gas out from the chamber 11 are communicated with the lower portion (hereinafter referred to as the "manifold") 18 of the chamber 11. The roughing exhaust pipe 15 has a DP (dry pump), not shown, connected thereto, and the main exhaust pipe 16 has a TMP (turbo-molecular pump), not shown, connected thereto. Moreover, the baffle plate 14 captures or reflects ions and radicals produced in a processing space S, described below, in the reaction chamber 17, thus preventing leakage of the ions and radicals into the manifold 18.

The roughing exhaust pipe 15, the main exhaust pipe 16, the DP, and the TMP together constitute an exhausting apparatus. The roughing exhaust pipe 15 and the main exhaust pipe 16 exhaust gas in the reaction chamber 17 out of the chamber 11 via the manifold 18. Specifically, the roughing exhaust pipe 15 reduces the pressure in the chamber 11 from atmospheric pressure down to a low vacuum state, and the main exhaust pipe 16 is operated in collaboration with the roughing exhaust pipe 15 to reduce the pressure in the chamber 11 from atmospheric pressure down to a high vacuum state (e.g. a pressure of not more than 133 Pa (1 torr)), which is at a lower pressure than the low vacuum state.

A lower radio frequency power source 20 is connected to the susceptor 12 via a matcher 22. The lower radio frequency power source 20 applies predetermined radio frequency electrical power to the susceptor 12. The susceptor 12 thus acts as a lower electrode. The matcher 22 reduces reflection of the radio frequency electrical power from the susceptor 12 so as to maximize the efficiency of the supply of the radio frequency electrical power into the susceptor 12.

A disk-shaped electrostatic chuck 42*a* comprised of an insulating member having an electrode plate 23 therein is provided in an upper portion of the susceptor 12, a surface of the electrostatic chuck 42*a* having been processed using the surface treatment method according to the present embodiment, described below. When a wafer W is mounted on the susceptor 12, the wafer W is disposed on the electrostatic chuck 42*a*. A DC power source 24 is electrically connected to the electrode plate 23. Upon a negative DC voltage being applied to the electrode plate 23, a positive potential is produced on a surface (hereinafter referred to as the "rear surface") of the wafer W on the electrostatic chuck 42*a* side, and a negative potential is produced on a surface (hereinafter referred to as the "front surface") of the wafer W on the opposite side to the electrostatic chuck 42*a*. A potential difference thus arises between the electrode plate 23 and the rear surface of the wafer W, and hence the wafer W is attracted to and held on an upper surface of the electrostatic chuck 42*a* through a Coulomb force or a Johnsen-Rahbek force due to the potential difference.

Moreover, an annular focus ring 25 is provided on an upper portion of the susceptor 12 so as to surround the wafer W attracted to and held on the upper surface of the electrostatic chuck 42*a*. The focus ring 25 is exposed to the processing space S, and focuses plasma in the processing space S toward the front surface of the wafer W, thus improving the efficiency of the etching processing.

An annular coolant chamber 26 that extends, for example, in a circumferential direction of the susceptor 12 is provided inside the susceptor 12. A coolant, for example cooling water or a Galden fluid, at a predetermined temperature is circulated through the coolant chamber 26 via coolant piping 27 from a chiller unit (not shown) . A processing temperature of the wafer W attracted to and held on the upper surface of the electrostatic chuck 42*a* is controlled through the temperature of the coolant.

A plurality of heat transfer gas supply holes 28 are opened to a portion of the upper surface of the electrostatic chuck 42*a* on which the wafer W is attracted and held (hereinafter referred to as the "attracting surface"). The heat transfer gas supply holes 28 are connected to a heat transfer gas supply unit (not shown) by a heat transfer gas supply line 30. The heat transfer gas supply unit supplies helium (He) gas as a heat transfer gas via the heat transfer gas supply holes 28 into a gap between the attracting surface of the susceptor 12 and the rear surface of the wafer W. The helium gas supplied into the gap between the attracting surface of the susceptor 12 and the rear surface of the wafer W transfers heat from the wafer W to the susceptor 12.

A plurality of pusher pins (not shown) are provided in the attracting surface of the susceptor 12 as lifting pins that can be made to project out from the upper surface of the electrostatic chuck 42*a*. The pusher pins are connected to a motor by a ball screw (neither shown), and can be made to project out from the attracting surface of the susceptor 12 with rotation of the motor, which is converted into linear motion by the ball screw. The pusher pins are housed inside the susceptor 12 when a wafer W is being attracted to and held on the attracting surface of the susceptor 12 so that the wafer W can be subjected to the etching processing, and are made to project out from the upper surface of the electrostatic chuck 42*a* so as to lift the wafer W up away from the susceptor 12 when the wafer W is to be transferred out from the chamber 11 after having been subjected to the etching processing.

A gas introducing shower head 34 is disposed in a ceiling portion of the chamber 11 such as to face the susceptor 12. An upper radio frequency power source 36 is connected to the gas introducing shower head 34 via a matcher 35. The upper radio frequency power source 36 applies predetermined radio frequency electrical power to the gas introducing shower head 34. The gas introducing shower head 34 thus acts as an upper electrode. The matcher 35 has a similar function to the matcher 22, described earlier.

The gas introducing shower head 34 has a ceiling electrode plate 38 having a large number of gas holes 37 therein, and an electrode support 39 on which the ceiling electrode plate 38 is detachably supported. A buffer chamber 40 is provided inside the electrode support 39. A processing gas introducing pipe 41 is connected to the buffer chamber 40. A processing gas, for example a mixed gas of a brominated gas or a chlorinated gas having $O_2$ gas and an inert gas such as He added thereto, supplied from the processing gas introducing pipe 41 into the buffer chamber 40 is supplied by the gas introducing shower head 34 into the reaction chamber 17 via the gas holes 37.

A transfer port 43 for the wafers W is provided in a side wall of the chamber 11 in a position at the height of a wafer W that has been lifted up from the susceptor 12 by the pusher pins. A gate valve 44 for opening and closing the transfer port 43 is provided in the transfer port 43.

Radio frequency electrical power is applied to the susceptor 12 and the gas introducing shower head 34 in the reaction chamber 17 of the substrate processing apparatus 10 as described above so as to apply radio frequency electrical power into the processing space S between the susceptor 12 and the gas introducing shower head 34, whereupon the processing gas supplied into the processing space S from the gas introducing shower head 34 is turned into high-density plasma, whereby ions and radicals are produced; the wafer W is subjected to the etching processing by the ions and so on.

Operation of the component elements of the substrate processing apparatus 10 described above is controlled in accordance with a program for the etching processing by a CPU of a control unit (not shown) of the substrate processing apparatus 10.

Figure 2A:
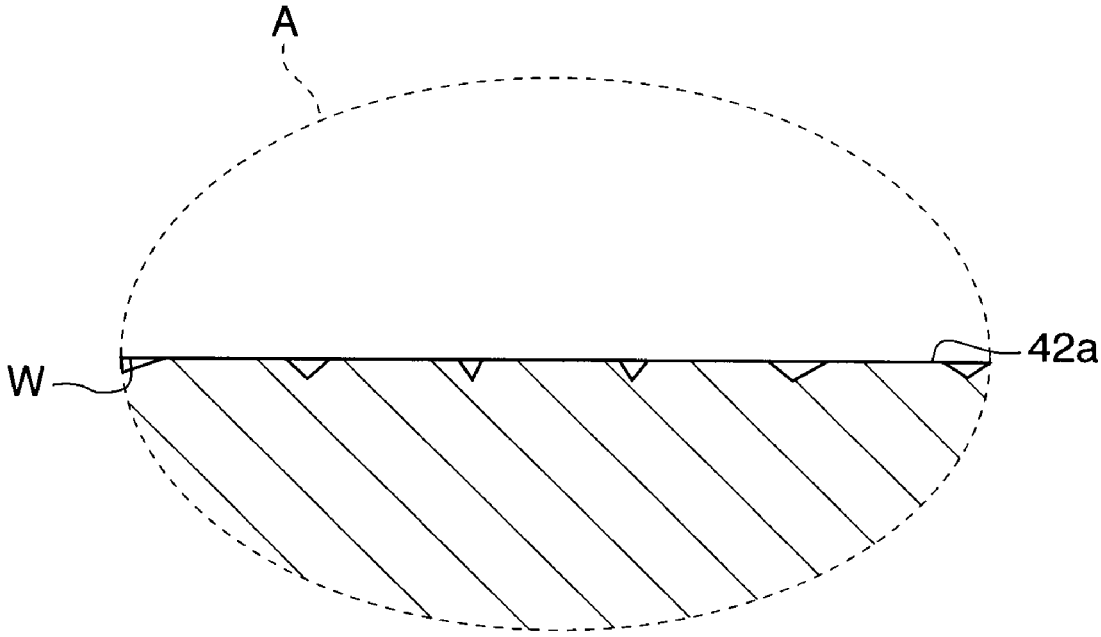
FIG. 2A is an enlarged view of a portion A shown in FIG. 1, being a portion of a surface of the electrostatic chuck according to the above embodiment.
Figure 2B:
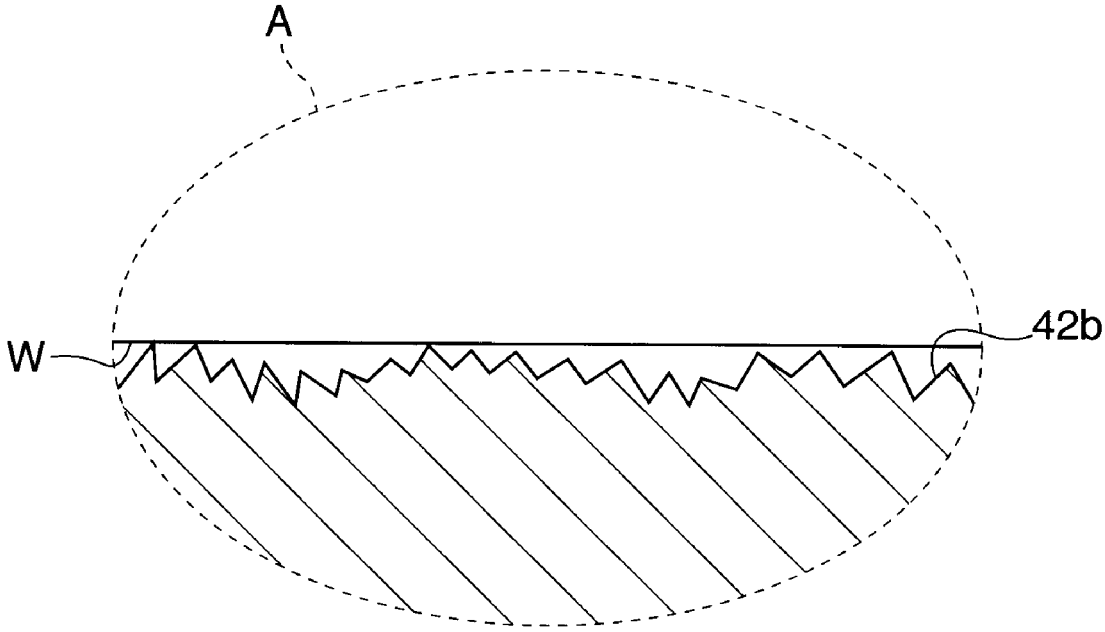
FIG. 2B is a partial enlarged view showing a portion of a surface of a conventional electrostatic chuck.

FIG. 2A is an enlarged view of a portion A shown in FIG. 1, showing a portion of the surface of the electrostatic chuck according to the present embodiment. FIG. 2B shows an equivalent portion of a surface of a conventional electrostatic chuck.

As shown in FIG. 2A, in the present embodiment, the electrostatic chuck 42*a* has the attracting surface thereof flattened, and furthermore has an extreme surface layer of the attracting surface thereof smoothed, whereby the contact area between the electrostatic chuck 42*a* and a wafer W is high. On the other hand, for the conventional electrostatic chuck 42*b* shown in FIG. 2B, the attracting surface thereof is rough, and furthermore there are minute undulations, and hence the contact area between the electrostatic chuck 42*b* and a wafer W is low.

Next, the surface treatment method according to the embodiment of the present invention will be described. As described above, a surface of an electrostatic chuck is processed using the surface treatment method according to the present embodiment.

FIGS. 3A, 3C, 3E, and 3G are views for explaining the surface treatment method according to the present embodiment.

Figure 3A:
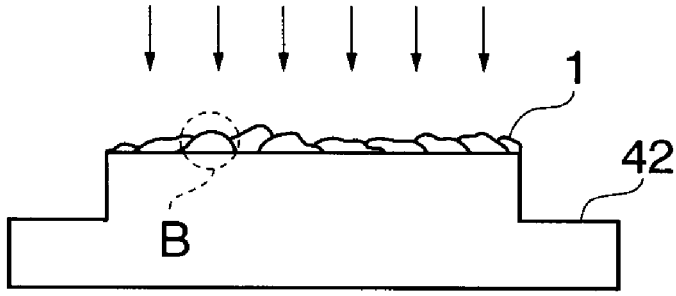
FIG. 3A is a view showing a thermal spraying step of the surface treatment method according to the above embodiment.
Figure 3B:
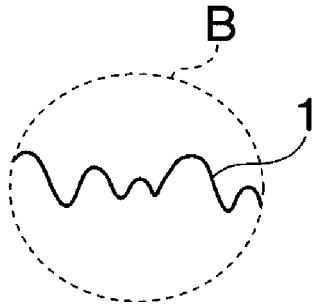
FIG. 3B is an enlarged view of a portion B shown in FIG. 3A.
Figure 3C:
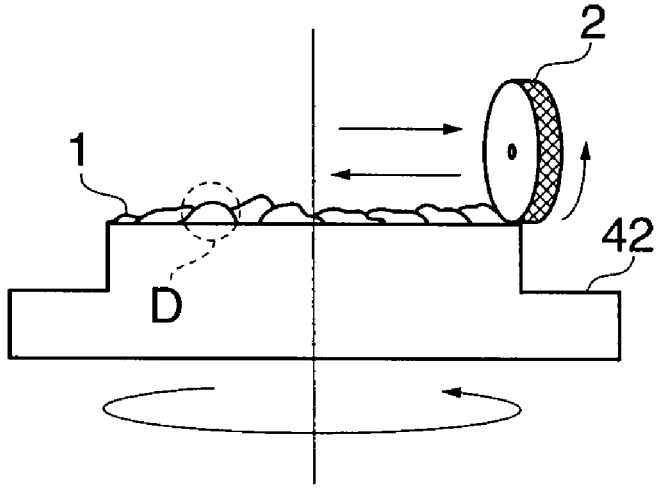
FIG. 3C is a view showing a grinding step carried out after the thermal spraying step.
Figure 3D:
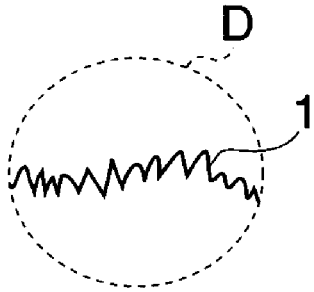
FIG. 3D is an enlarged view of a portion D shown in FIG. 3C.
Figure 3E:
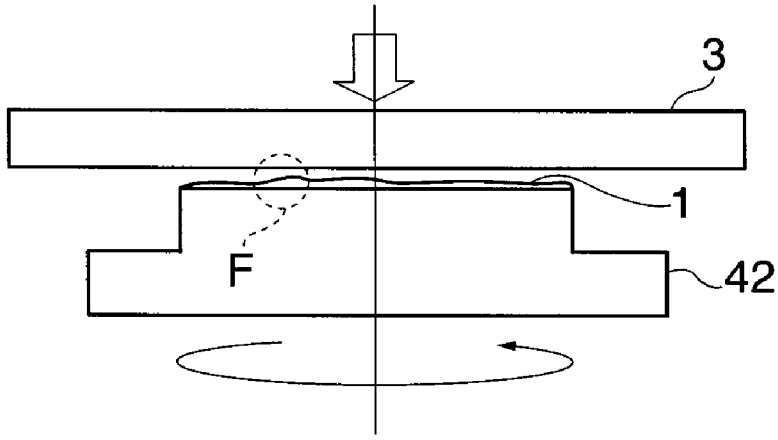
FIG. 3E is a view showing a plate lapping step carried out after the grinding step.
Figure 3F:
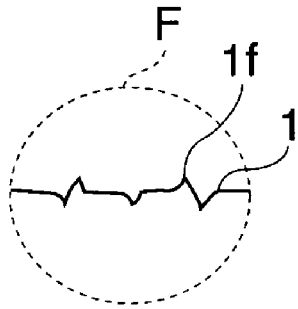
FIG. 3F is an enlarged view of a portion F shown in FIG. 3E.
Figure 3G:
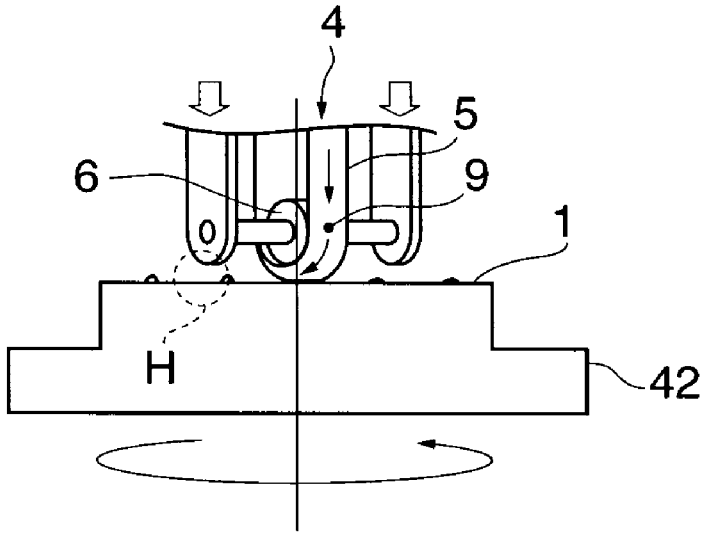
FIG. 3G is a view showing a tape lapping step carried out after the plate lapping step.

Moreover, FIGS. 3B, 3D, 3F, and 3H are enlarged views of a portion B shown in FIG. 3A, a portion D shown in FIG. 3C, a portion F shown in FIG. 3E, and a portion H shown in FIG. 3G respectively.

In the surface treatment method according to the present embodiment, first, as shown in FIG. 3A, a sprayed coating film 1 is formed on the surface of an electrostatic chuck 42 by thermally spraying with a ceramic such as alumina (hereinafter referred to as the "thermal spraying step") . After the thermal spraying step, as shown in FIG. 3B, the surface of the electrostatic chuck 42 is rough, and furthermore there are undulations on the surface of the electrostatic chuck 42.

Next, a grindstone 2 obtained by compacting together abrasive grains and making into a disk shape is brought into contact with the surface of the electrostatic chuck 42 that has been subjected to the thermal spraying step. The grindstone 2 is moved parallel to the surface of the electrostatic chuck 42 and rotated, and the electrostatic chuck 42 is rotated about an axis of rotation shown by the alternate long and short dash line in FIG. 3C (FIG. 3C). As a result, the surface of the electrostatic chuck 42 is ground (hereinafter referred to as the "grinding step" (first flattening step)) . After the grinding step, as shown in FIG. 3D, when viewed microscopically, the surface of the electrostatic chuck 42 is still rough, and furthermore there are still minute undulations on the surface of the electrostatic chuck 42.

A lapping plate 3 is thus brought into contact with the surface of the electrostatic chuck 42 that has been subjected to the grinding step. A suspension in which are mixed abrasive grains and a lubricant is sprayed onto a surface of the lapping plate 3. Moreover, a load (shown by the white blank arrow in FIG. 3E) is applied to the lapping plate 3, and the electrostatic chuck 42 is rotated about an axis of rotation shown by the alternate long and short dash line in FIG. 3E. As a result, the surface of the electrostatic chuck 42 is ground flat (hereinafter referred to as the "plate lapping step" (second flattening step)) . After the plate lapping step, as shown in FIG. 3F, the minute undulations that were on the surface of the electrostatic chuck 42 have been removed, the surface of the electrostatic chuck 42 being flat, but when viewed microscopically, minute projections 1*f* have been formed on an extreme surface layer of the surface of the electrostatic chuck 42.

After the plate lapping step, the surface of the electrostatic chuck 42 is thus smoothed using a tape lapping apparatus 4 having a tape 5 whose surface has abrasive grains 9 coated and fixed thereon and a roller 6 made of an elastic material. Specifically, the tape 5 of the tape lapping apparatus 4 is made to contact the surface of the electrostatic chuck 42 by applying pressure (shown by the white blank arrows in FIG. 3G) to the tape lapping apparatus 4. The tape 5 is wound in and wound out by the tape lapping apparatus 4, the tape lapping apparatus 4 is moved parallel to the surface of the electrostatic chuck 42, and the electrostatic chuck 42 is rotated about an axis of rotation shown by the alternate long and short dash line in FIG. 3G. As a result, the surface of the electrostatic chuck 42 is ground smooth (hereinafter referred to as the "tape lapping step" (smoothing step)).

Figure 3H:
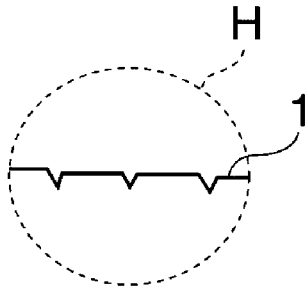
FIG. 3H is an enlarged view of a portion H shown in FIG. 3G.
Figure 4A:
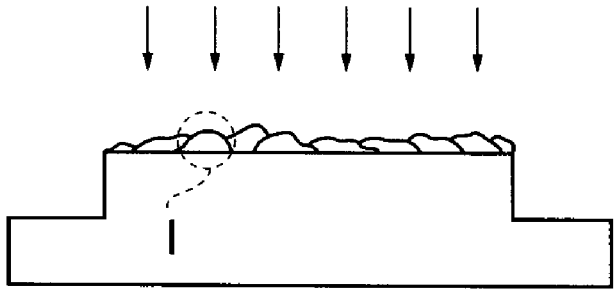
FIG. 4A is a view showing a thermal spraying step of a conventional electrostatic chuck surface treatment method.
Figure 4B:
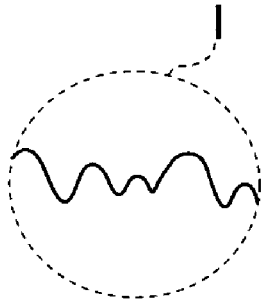
FIG. 4B is an enlarged view of a portion I shown in FIG. 4A.
Figure 4C:
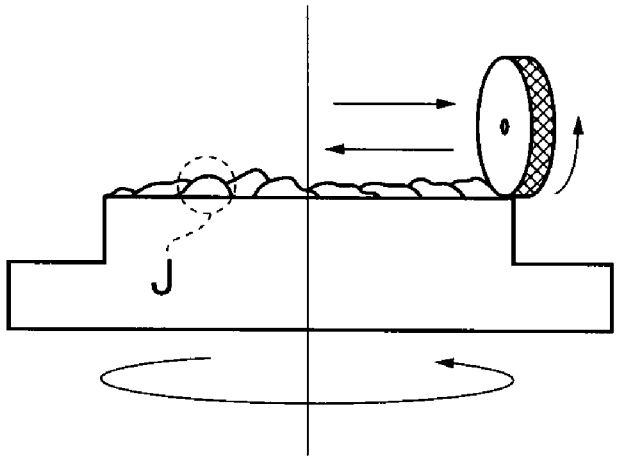
FIG. 4C is a view showing a grinding step carried out after the thermal spraying step.
Figure 4D:
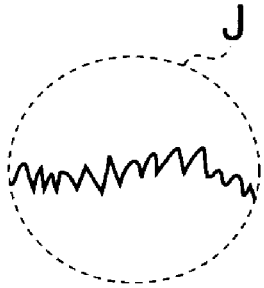
FIG. 4D is an enlarged view of a portion J shown in FIG. 4C.

In particular, in the tape lapping step, because the tape 5 is pushed against the surface of the electrostatic chuck 42 by the roller 6 which is made of an elastic material, the pushing pressure of the tape 5 can be controlled through the elasticity of the roller 6, and hence the extreme surface layer of the surface of the electrostatic chuck 42 can be finely smoothed. After the tape lapping step, as shown in FIG. 3H, even the extreme surface layer of the surface of the electrostatic chuck 42 is smooth, the electrostatic chuck 42 having the same form as the electrostatic chuck 42*a* shown in FIG. 2A described above.

The abrasive grains used in each of the steps after the thermal spraying step in the present embodiment are preferably substantially the same as or smaller in size than in those used in the previous step. To efficiently and completely smooth even the extreme surface layer of the surface having the sprayed coating film formed thereon, it is preferable to make the abrasive grains smaller in size as the steps proceed. Note, however, that in the present embodiment, the processing method itself is specifically such that the extreme surface layer can be smoothed more in the tape lapping step than in the plate lapping step, and more in the tape lapping step than in the grinding step. Hence the extreme surface layer can be completely smoothed, even if abrasive grains of substantially the same size as those used in the previous step are used.

According to the surface treatment method of the present embodiment, the surface of the electrostatic chuck 42 having the sprayed coating film 1 formed thereon is flattened (plate lapping step), and then the extreme surface layer of the surface of the electrostatic chuck 42 is smoothed (tape lapping step). As a result, the contact area between a wafer W and the surface of the electrostatic chuck 42 can be increased, and hence the efficiency of heat transfer between the wafer W and the surface of the electrostatic chuck 42 can be markedly improved. When controlling the processing temperature of the wafer W, there is thus no need to use a high-performance chiller unit, and hence power saving can be achieved for the chiller unit. Moreover, even in the case that the etching process carried out on the wafer W is divided into a plurality of steps, the temperature of the wafer W can be controlled with good response when changing steps, and hence the requirements of a variety of etching characteristics can be met. Furthermore, because the efficiency of heat transfer between the wafer W and the surface of the electrostatic chuck 42 can be markedly improved, even in the case of wishing to reduce the temperature of the wafer W, there is no need to excessively increase the pressure of a heat transfer gas, and hence detachment of the wafer W from the electrostatic chuck 42 can be prevented.

Next, a surface treatment method according to a second embodiment of the present invention will be described.

For the present embodiment, the construction and operation are basically the same as for the first embodiment described above, the only difference to the first embodiment being that the plate lapping step is omitted. Features of the construction and operation that are the same as in the first embodiment will thus not be described, only features of the construction and operation that are different to in the first embodiment being described below with reference to FIG. 3.

In the surface treatment method according to the present embodiment, the electrostatic chuck is subjected to the thermal spraying step shown in FIG. 3A, then to the grinding step shown in FIG. 3C, and then to the tape lapping step shown in FIG. 3G.

In the present embodiment, after the tape lapping step, there are minute undulations on the surface of the electrostatic chuck, but regardless of the state of the undulations, the extreme surface layer of the surface of the electrostatic chuck has been smoothed.

According to the surface treatment method of the present embodiment, the extreme surface layer of the surface of the electrostatic chuck having the sprayed coating film formed thereon is smoothed (tape lapping step). As a result, effects as for the first embodiment described above can be achieved. Furthermore, the plate lapping step which was carried out on the electrostatic chuck in the first embodiment is omitted. As a result, the number of steps can be reduced.

Next, a surface treatment method according to a third embodiment of the present invention will be described.

For the present embodiment, the construction and operation are basically the same as for the first embodiment described above, the only difference to the first embodiment being that the grinding step is omitted. Features of the construction and operation that are the same as in the first embodiment will thus not be described, only features of the construction and operation that are different to those in the first embodiment being described below with reference to FIG. 3.

In the surface treatment method according to the present embodiment, the electrostatic chuck is subjected to the thermal spraying step shown in FIG. 3A, then to the plate lapping step shown in FIG. 3E, and then to the tape lapping step shown in FIG. 3G.

In the present embodiment, after the tape lapping step, the surface of the electrostatic chuck has been flattened, and furthermore the extreme surface layer of the surface of the electrostatic chuck has been smoothed.

According to the surface treatment method of the present embodiment, the surface of the electrostatic chuck having the sprayed coating film formed thereon is flattened (plate lapping step), and furthermore the extreme surface layer of the surface of the electrostatic chuck is smoothed (tape lapping step). As a result, effects as for the first embodiment described above can be achieved. Furthermore, the grinding step which was carried out on the electrostatic chuck in the first embodiment is omitted. As a result, the number of steps can be reduced.

In each of the embodiments described above, the object processed is an electrostatic chuck having a sprayed coating film formed thereon. However, the object processed is not limited to this, but rather may be any member having a sprayed coating film formed thereon. Moreover, through the tape lapping step of the surface treatment method according to the present embodiment, even in the case of an electrostatic chuck made of a ceramic formed by firing or the like, the extreme surface layer of the surface of the electrostatic chuck can be smoothed. The electrostatic chuck that is processed is thus not limited to being an electrostatic chuck having a sprayed coating film formed thereon, but rather may alternatively be an electrostatic chuck made of a ceramic formed by firing or the like.

Moreover, through the tape lapping step of the surface treatment method according to the present embodiment, the extreme surface layer of the surface of the electrostatic chuck is smoothed, and a fractured layer on the surface of the electrostatic chuck is removed. As a result, particles can be prevented from arising on the rear surface of a wafer W through the contact between the wafer W and the surface of the electrostatic chuck.

Moreover, through the tape lapping step of the surface treatment method according to the present embodiment, the extreme surface layer of the surface of a component is smoothed, and a fractured layer on the surface of the component is removed. As a result, particles can be prevented from arising in the chamber.

Furthermore, according to the tape lapping step of the surface treatment method according to the present embodiment, the object processed is not limited to being a planar surface, but rather a curved surface may also be processed, for example an inner periphery of the chamber may be processed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A surface treatment method for a substrate mounting surface of a stage that is disposed in a substrate processing apparatus that carries out processing on a substrate and has the substrate mounted thereon, the method comprising:

a film forming step of forming a thermally sprayed coating film on the substrate mounting surface;

a flattening step of improving a flatness of the substrate mounting surface by removing minute undulations on the substrate mounting surface; and a smoothing step of smoothing the substrate mounting surface whose flatness has been improved using tape coated with abrasive grains after said flattening step, wherein in said smoothing step, the tape is pushed against the substrate mounting surface, on which the thermally sprayed coating film has been formed, by a roller made of an elastic material.

2. A surface treatment method as claimed in claim 1, wherein said flattening step has a first flattening step of flattening the substrate mounting surface using a grindstone, and a second flattening step of further flattening the flattened substrate mounting surface using a plate coated with abrasive grains by removing minute undulations on the flattened substrate mounting surface.

3. A surface treatment method as claimed in claim 2, wherein in said second flattening step, a load toward the substrate mounting surface is applied to the plate.

4. A surface treatment method for a thermally sprayed coating film formed on a member to be disposed in a substrate processing apparatus that carries out processing on a substrate, the method comprising:

a film forming step of forming the thermally sprayed coating film;

a flattening step of improving a flatness of a surface of the thermally sprayed coating film; and a smoothing step of smoothing the surface of the thermally sprayed coating film whose flatness has been improved using tape coated with abrasive grains by removing minute undulations on the surface of the thermally sprayed coating film after said flattening step, wherein in said smoothing step, the tape is pushed against the surface of the thermally sprayed coating film by a roller made of an elastic material.

5. A surface treatment method as claimed in claim 4, wherein said flattening step has a first flattening step of flattening the surface of the thermally sprayed coating film using a grindstone, and a second flattening step of further flattening the flattened surface of the thermally sprayed coating film using a plate coated with abrasive grains by removing minute undulations on the flattened surface of the thermally sprayed coating film.

6. A surface treatment method as claimed in claim 5, wherein in said second flattening step, a load toward the surface of the thermally sprayed coating film is applied to the plate.

* * * * *